US009044124B2

(12) United States Patent
Hagleitner

(10) Patent No.: US 9,044,124 B2
(45) Date of Patent: Jun. 2, 2015

(54) PAPER DISPENSER

(71) Applicant: Hans Georg Hagleitner, Zell am See (AT)

(72) Inventor: Hans Georg Hagleitner, Zell am See (AT)

( * ) Notice: Subject to any disclaimer, the term of this patent is extended or adjusted under 35 U.S.C. 154(b) by 399 days.

(21) Appl. No.: 13/658,018

(22) Filed: Oct. 23, 2012

(65) Prior Publication Data

US 2013/0043266 A1 Feb. 21, 2013

Related U.S. Application Data

(63) Continuation of application No. PCT/AT2011/000201, filed on Apr. 21, 2011.

(30) Foreign Application Priority Data

Apr. 23, 2010 (AT) ..... A 676/2010

(51) Int. Cl.
*B65H 16/10* (2006.01)
*A47K 10/36* (2006.01)

(52) U.S. Cl.
CPC ..... *A47K 10/36* (2013.01)

(58) Field of Classification Search
CPC ..... A47K 10/32; A47K 10/34; A47K 10/36
USPC ..... 242/564, 564.1, 564.2, 564.3, 564.4, 242/565
See application file for complete search history.

(56) References Cited

U.S. PATENT DOCUMENTS

| | | | | |
|---|---|---|---|---|
| 1,975,414 | A * | 10/1934 | Wade | 83/232 |
| 2,051,242 | A | 8/1936 | Birr, et al. | |
| 2,139,339 | A | 12/1938 | Vaughan, et al. | |
| 2,369,851 | A | 2/1945 | Price, et al. | |
| 2,592,786 | A * | 4/1952 | Birr | 242/564.1 |
| 2,601,956 | A * | 7/1952 | Birr | 242/564.1 |
| 2,930,664 | A * | 3/1960 | Liebisch | 242/560 |
| 3,017,131 | A * | 1/1962 | Wooster | 242/564.1 |
| 4,137,805 | A * | 2/1979 | DeLuca et al. | 83/345 |
| 5,244,161 | A * | 9/1993 | Wirtz-Odenthal | 242/560.1 |
| 5,937,718 | A * | 8/1999 | Granger | 83/334 |
| 6,446,901 | B1 * | 9/2002 | Haen et al. | 242/564.1 |
| 6,550,714 | B1 * | 4/2003 | Granger | 242/564.4 |
| 6,644,155 | B2 * | 11/2003 | Phelps et al. | 83/339 |
| 8,657,225 | B2 * | 2/2014 | Hagleitner | 242/564.4 |

FOREIGN PATENT DOCUMENTS

| | | |
|---|---|---|
| CH | 423 140 A | 10/1966 |
| DE | 934 668 C | 11/1955 |
| DE | 33 18 008 A1 | 11/1984 |

* cited by examiner

*Primary Examiner* — William A Rivera

(74) *Attorney, Agent, or Firm* — Laurence A. Greenberg; Werner H. Stemer; Ralph E. Locher

(57) ABSTRACT

A paper dispenser dispenses paper sheet by sheet. Paper projects from a dispenser housing in an operational position so that it can be pulled off from a supply roll by hand. The paper dispenser has a delivery roller driven by the web of paper that is being pulled. A stop which is moved from a rest position to a blocked position against the force of a return spring blocks the rotation of the delivery roller so that the sheet is torn off due to the pulling power, and is slowed down by a braking device when returning to the rest position. A post-delivery device is configured to further drive the delivery roller once the sheet has been torn off and completes the rotation in a time-delayed manner so that the paper projects from the dispenser housing and can be pulled again.

8 Claims, 4 Drawing Sheets

PAPER DISPENSER

CROSS-REFERENCE TO RELATED APPLICATION

This application is a continuation, under 35 U.S.C. §120, of copending international application No. PCT/AT2011/000201, filed Apr. 21, 2011, which designated the United States; this application also claims the priority, under 35 U.S.C. §119, of Austrian patent application No. AT A676/2010, filed Apr. 23, 2010; the prior applications are herewith incorporated by reference in their entireties.

BACKGROUND OF THE INVENTION

Field of the Invention

The invention relates to a paper dispenser for dispensing paper sheet by sheet. The paper projects from the dispenser housing in an operational position, so that it can be pulled off from a supply roll by hand. The paper dispenser has a delivery roller driven by the web of paper that is being pulled, a stop which can be moved between a blocked position and a rest position and which, in the blocked position, blocks the rotation of the delivery roller, so that the sheet is torn off on account of the pulling force, and which, returned into the rest position, permits the rotation of the delivery roller again. The paper dispenser further has a post-delivery device which, after the sheet has been torn off, further drives the delivery roll and completes the rotation, so that the paper projects from the dispenser housing and can be grasped again.

A dispenser of this type is described in Swiss patent CH 423 140, for example, a suction cup device being employed as a time delay element in order to prevent continuous further delivery of the paper. The suction cup device contains two suction cups that can be pressed against each other and require a specific time in order to be detached from each other again. During this time, the rotation of the delivery roller is not possible, since the stop is located in the rotational path of a spiral guideway rotating with the delivery roller.

Although these suction cup devices function passably well, they are susceptible to faults because of contamination and material fatigue.

SUMMARY OF THE INVENTION

It is accordingly an object of the invention to provide a paper dispenser which overcomes the above-mentioned disadvantages of the prior art devices of this general type, which is improved in such a way that the susceptibility to faults becomes lower as a result of the use of more rugged components.

With the foregoing and other objects in view there is provided, in accordance with the invention a paper dispenser for dispensing paper sheet by sheet. The paper dispenser contains a dispenser housing where the paper projects from the dispenser housing in an operational position, so that the paper can be pulled off from a supply roll by hand. A delivery roller is driven by a web of the paper that is being pulled. A stop is provided which can be moved between a blocked position and a rest position and the stop, in the blocked position, blocks a rotation of the delivery roller, so that the sheet is torn off on account of a pulling force. Once the stop is returned into the rest position, it permits a rotation of the delivery roller again. A post-delivery device is provided which, after the sheet has been torn off, further drives the delivery roller and completes a rotation, so that the paper projects from the dispenser housing and can be grasped again. A braking device is provided for braking the stop as the stop travels into the rest position.

According to the invention, this is achieved in that a braking device is provided which brakes the stop as the latter travels into the rest position. The braked return of the stop, loaded into the rest position by the force of gravity but in particular by a spring, permits the stop displaced into the blocked position to be guided slowly back into the rest position again after the stoppage of the delivery roller that is necessary to tear off the paper, without having to dispense with a time delay, so that a suction cup device can be omitted, as intended. The slow return includes the time delay, since the braking device counteracts the loading on the stop.

The braking device preferably acts during the entire return travel into the rest position; however, it would also be conceivable to end the braking before the end of the travel, in order to shorten the time delay.

In the paper dispenser according to the invention, provision is made in a preferred embodiment for the force of the return spring to be adjustable, so that the return time of the stop, by which the time interval between two possible paper removals is determined, can be adjusted. For example, the abutment of the return spring could be mounted in several positions in the dispenser.

For the practical configuration of the braking device, a plurality of possibilities is recommended. In a first preferred embodiment, the braking device contains a linear damper which is arranged in parallel with the return spring in the dispenser.

A further preferred embodiment provides for the braking device to contain a rotational damper and for the stop to have teeth, in which a ring gear of the rotational damper engages.

Both linear dampers (having a piston-cylinder unit) and rotational dampers are simple mechanical components in which the relative movement between two elements is opposed by a high resistance by using a medium of high viscosity.

The transfer of the stop from the rest position into the blocked position for the delivery roller is in particular effected by the rotation of the delivery roller itself, if the delivery roller is provided with a guideway varying in terms of its distance from the axis of rotation and on which the movable stop is guided. The rotation of the delivery roller from the operational position by a manual pull on the paper web rotates the guideway, which approaches the axis of rotation spirally. A guideway follower element, which is connected to the stop that is acted on by the return spring, rests on the guideway, so that the stop is displaced and the return spring is compressed. At the end of the guideway, the stop is in the rotational path of a mating stop on the delivery roller and the rotation of the latter is stopped. The sheet of paper is torn off. At the same time, a step back in the guideway releases the guideway follower element, so that the stop is moved back into the rest position by the tensioned return spring. However, the braking device avoids the abrupt or rapid expansion of the return spring, so that the stop moves slowly into the rest position, in which the guideway follower element again rests on the start of the guideway.

Since the drive of the delivery roller by the paper web that is being pulled has ceased because of the sheet of paper having been torn off, the post-delivery device, which performs the remaining rotation of the delivery roller over about 80° to 120°, now starts. The post-delivery device preferably contains a generously dimensioned helical spring, which has previously been tensioned in the first part of the rotation and has been moved above the top dead center of the delivery axis. The helical spring can therefore contract again as soon as the stop has reached the rest position and, in the process, can complete the rotation of the delivery roller, the paper web being delivered to such an extent that the current end again projects out of the dispenser housing in the operational position.

In the event of a paper jam or the like, in a further preferred embodiment an emergency actuating lever is provided, the actuation of which sets the delivery roller rotating and disengages the braking device from the stop.

Other features which are considered as characteristic for the invention are set forth in the appended claims.

Although the invention is illustrated and described herein as embodied in a paper dispenser, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
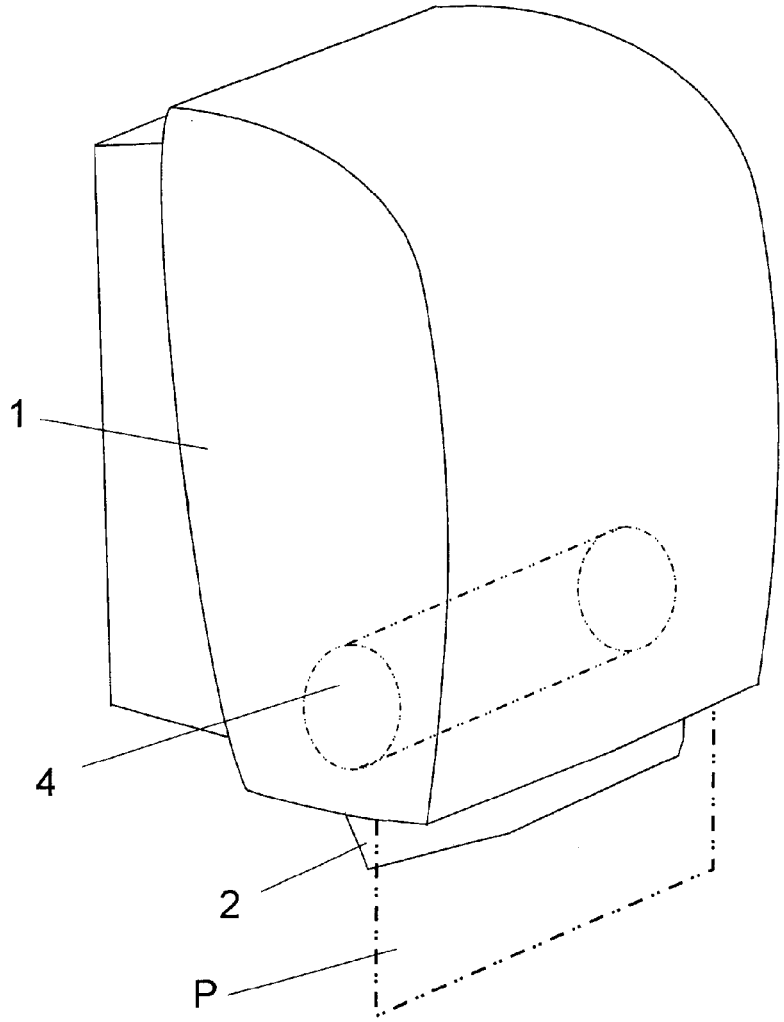
FIG. 1 is a diagrammatic, perspective view of a paper dispenser according to the invention.

Referring now to the figures of the drawing in detail and first, particularly, to FIG. 1 thereof, there is shown a paper dispenser that has a dispenser housing 1, on a front side of which an end of a paper web P, which is pulled off a roll, projects through an outlet slot, not specifically designated. The paper web can already have transverse perforations but can likewise be cut for the first time in the dispenser, for example by being guided over a knife roller from which a knife is driven out and in under rotational control. In this case, the cut is not made continuously over the entire width; instead two short uncut regions preferably remain, so that the sheet can and must be torn off.

The dispenser is driven purely mechanically, which means that a user grasps the end of the paper web P projecting in the operational position of the dispenser according to FIG. 1 and pulls thereon. It starts to move a delivery roller 4 in the interior, which can preferably simultaneously constitute the aforementioned knife roller. In the following figures, the region of the delivery roller 4 around which the paper web wraps is not shown, instead only the components at the end, such as the gear wheel for an emergency drive, a guideway 5 for a control of a stop and a post-delivery device 20 taking over the drive as far as the completion of the rotation of the delivery roller 4 after the paper has been torn off and is no longer available for the further drive.

A stop 10 which is important can be moved by the guideway 5, which has a spiral guideway track, and which stop is provided on a carriage 11 which is able to move to and fro approximately diametrically in relation to an axis 3 of the delivery roller 4, a guideway follower element 19 provided on the carriage 11 being guided along the guideway 5. The carriage 11 is loaded by a return spring 13 which is supported on an abutment 14 and which—as can be seen from FIG. 8—can be fixed in a plurality of positions on the dispenser housing 1, in order to be able to choose the preload of the return spring 13.

Figure 2:
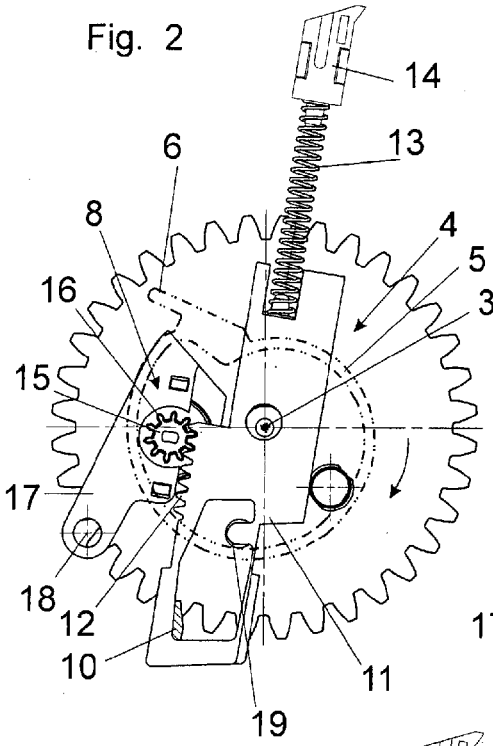
FIG. 2 is a side view of elements essential for stopping and post-delivery in an operational position of the paper dispenser.

The guideway 5 runs in such a way that, during rotation of the delivery roller 4 in the direction of the arrow, the guideway follower element 19 approaches the axis 3, the return spring 13 being increasingly compressed. In the process, the stop 10 moves out of its rest position shown in FIG. 2 into a blocked position according to FIG. 4, in which it is located in the rotational path of a mating stop 6 located on the delivery roller 4. The mating stop 6 is slightly resilient in order to damp the impact, so that the dispenser is quieter.

Figure 4:
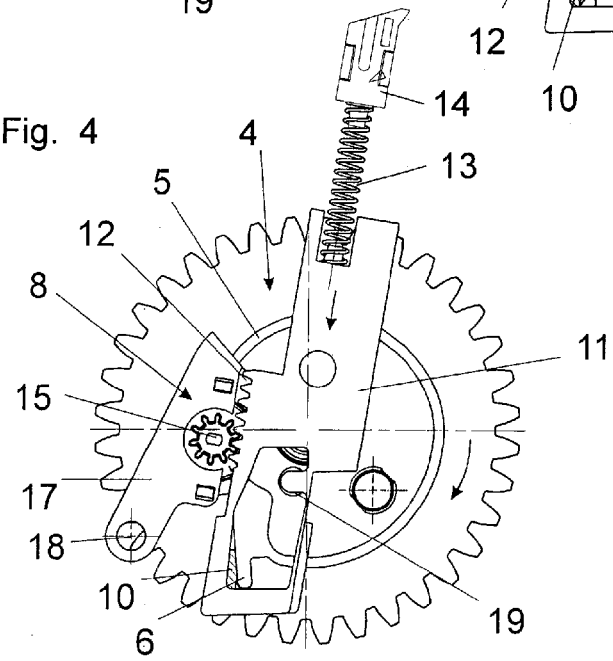
FIG. 4 is a side view showing the blocked position.

Since the slope of the guideway track ends slightly before the position shown in FIG. 4 and an approximately radial step back to the start is formed, the position of the guideway follower element 19 shown in FIG. 4 is free of the guideway 5, so that the carriage 11 can be displaced under the action of the return spring 13. This means that the delivery roller 4 driven by the pulled paper is stopped by the mating stop 6 encountering the stop 10, which means that the paper is torn off and the delivery roller 4 not only remains stationary but has also lost its drive. Starting from this instant, since the carriage 11 is free, the stop 10 can be displaced into its rest position, the desired time delay being achieved by a braking device 8 having a rotational damper 15 becoming active and working against the return spring 13. The rotational damper 15 is mounted on a lug 17 that can rotate about an axis 18 and has a ring gear 16 which engages in longitudinal teeth 12 on the carriage 11. As FIG. 4 shows, the contact surfaces of the stop 10 and of the mating stop 6 are parallel and at an angle to the direction of movement of the carriage, so that they are not in each other's way as they separate, i.e. during the braked transition to FIG. 5.

Figure 3:
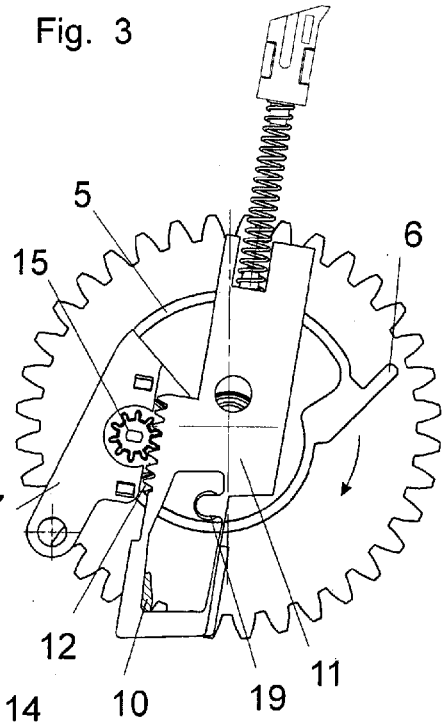
FIG. 3 is a side view showing a position at a start of a transfer of a stop to a blocked position.
Figure 5:
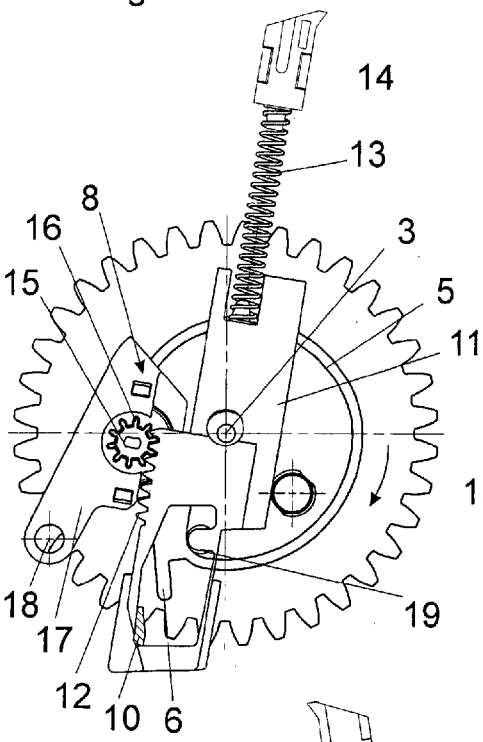
FIG. 5 is a side view showing the essential elements following a return into a rest position.
Figure 6:
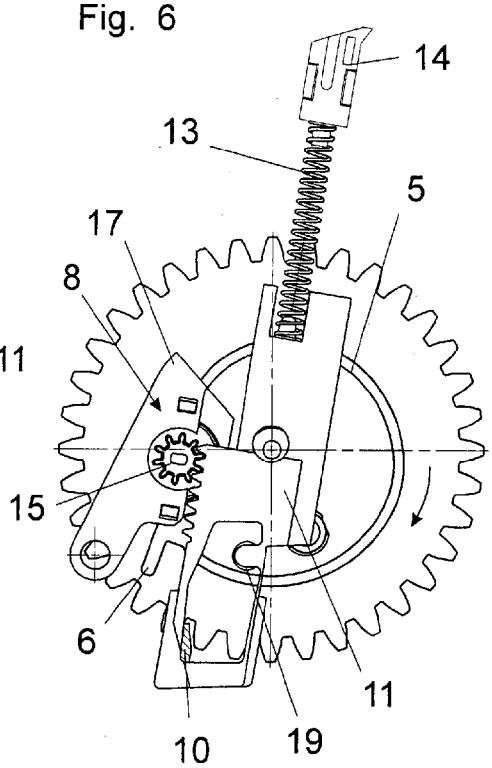
FIG. 6 is a side view showing a position during an action of a post-delivery device.
Figure 7:
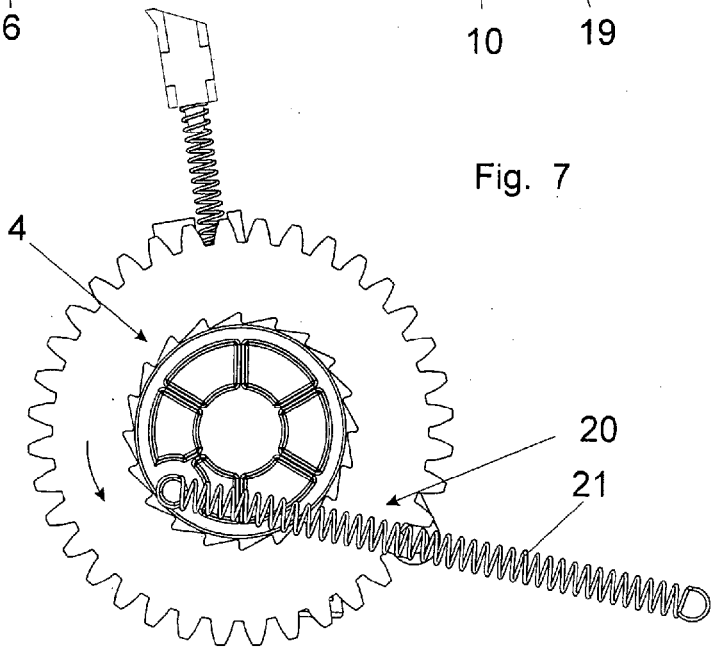
FIG. 7 is a side view showing the post-delivery device, arranged at the other end of the delivery roller for reasons of space.

The position according to FIG. 5 is somewhat inaccurate, for the purpose of better understanding, since a spring 21 of the post-delivery device 20 acts on the delivery roller 4 and the mating stop 6 correctly remains resting on the stop 10 until it is free of the latter. The post-delivery device 20 acting on the other end of the delivery roller 4 has the spring 21 which is hooked in close to the roller circumference, so that the spring 21 is tensioned by about 240° from FIG. 2 to FIG. 4 during the rotation of the delivery roller 4 and then moves beyond the top dead center and is located in the waiting position illustrated in FIG. 7 until the release of the mating stop 6 according to FIG. 5 has been reached. The spring 21 can then contract and effect the rotation of the delivery roller 4 through the remaining approximately 120°, an initial position of this residual rotation being emphasized in FIG. 6. In this region as far as the position according to FIG. 2, the guideway track is at the same distance from the axis of rotation 3, so that the carriage 11 is not moved, and the force of the spring 21 is used only to deliver the paper P by that length which is still necessary to reach the operational position according to FIG. 1 again.

As mentioned, the braking device 8 contains the rotational damper 15, which is mounted on a lug 17 that can be pivoted about the axis 18. As a result, the braking device 8 can be de-activated when the carriage 11 is moved against the return spring 13, since the ring gear 16 of the rotational damper 15 is forced outward from the teeth 12 and therefore does not brake the movement. During the return movement, the ring gear 16 is forced into the teeth 12 again and the braking is ensured by the inertia of the rotational damper.

Figure 8:
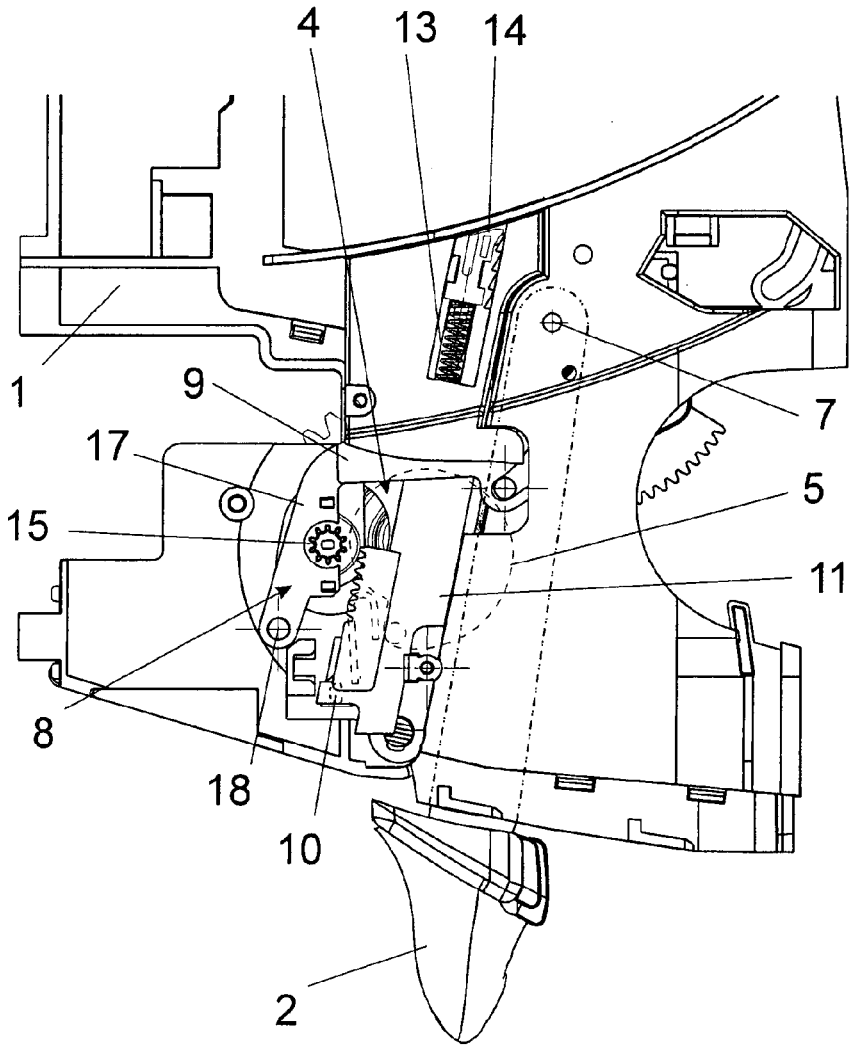
FIG. 8 is a schematic view of a lower region of the dispenser with an emergency actuating device.

The arrangement of the rotational damper 15 on the pivotable lug 17 also makes it possible, as FIG. 8 shows, to pivot the braking device 8 out also when, for example because of a paper jam, the emergency actuating key 2 has to be used to rotate the delivery roller 4. The emergency actuating key 2 can be pivoted about an axis 7 in the dispenser housing 1 and is coupled to a link 9, the free end of which presses against the lug 17. If the emergency actuating key 2 is pressed, the lug 17 is therefore pivoted and the rotational damper is disengaged from the teeth 12.

The invention claimed is:

1. A paper dispenser for dispensing paper sheet by sheet, the paper dispenser comprising:

a dispenser housing where the paper projects from said dispenser housing in an operational position, so that the paper can be pulled off from a supply roll by hand;

a delivery roller driven by a web of the paper that is being pulled;

a stop which can be moved between a blocked position and a rest position and said stop, in the blocked position, blocks a rotation of said delivery roller, so that the sheet is torn off on account of a pulling force, and said stop, returned into the rest position, permits a rotation of said delivery roller again;

a post-delivery device which, after the sheet has been torn off, further drives said delivery roller and completes a rotation, so that the paper projects from said dispenser housing and can be grasped again; and a braking device for braking said stop as said stop travels into the rest position, said braking device containing a rotational damper having a ring gear; and said stop having teeth, in which said ring gear of said rotational damper engages.

2. The paper dispenser according to claim 1, further comprising a return spring, said stop is loaded into the rest position by said return spring.

3. The paper dispenser according to claim 2, wherein a force of said return spring is adjustable.

4. The paper dispenser according to claim 2, further comprising:

a carriage carrying said stop; and a displaceable abutment, said return spring having a first end supported on said displaceable abutment and a second end supported on said carriage.

5. The paper dispenser according to claim 1, wherein said braking device brakes during an entire travel.

6. The paper dispenser according to claim 1, wherein said delivery roller has a guideway varying in terms of its distance from an axis of rotation, on said guideway said stop is guided from the rest position into the blocked position.

7. The paper dispenser according to claim 1, further comprising a mating stop associated with said delivery roller.

8. The paper dispenser according to claim 1, further comprising an emergency actuating lever, an actuation of said emergency lever setting said delivery roller rotating and disengages said braking device from said stop.

* * * * *